US010775051B2

(12) United States Patent
Lesage et al.

(10) Patent No.: US 10,775,051 B2
(45) Date of Patent: Sep. 15, 2020

(54) BACTERIA PREVENTIVE WATER HOLDING TANK CONSTRUCTION FOR ELECTRIC WATER HEATERS

(71) Applicant: MICLAU-S.R.I. INC., Montreal East (CA)

(72) Inventors: Claude Lesage, Pointe-Claire (CA); Jean-Claude Lesage, Kirkland (CA)

(73) Assignee: MICLAU-S.R.I. INC, Montreal East, QC (CA)

( * ) Notice: Subject to any disclaimer, the term of this patent is extended or adjusted under 35 U.S.C. 154(b) by 238 days.

(21) Appl. No.: 15/732,380

(22) Filed: Nov. 2, 2017

(65) Prior Publication Data

US 2019/0128540 A1 May 2, 2019

(51) Int. Cl.

| | |
|---|---|
| ***F24D 17/00*** | (2006.01) |
| ***F24H 1/18*** | (2006.01) |
| ***F24D 3/08*** | (2006.01) |
| ***F24H 1/20*** | (2006.01) |

(52) U.S. Cl.

CPC ..... *F24D 17/0073* (2013.01); *F24D 3/082* (2013.01); *F24H 1/181* (2013.01); *F24H 1/201* (2013.01); *F24D 2200/08* (2013.01)

(58) Field of Classification Search

None

See application file for complete search history.

(56) References Cited

U.S. PATENT DOCUMENTS 1,301,995 A * 4/1919 Arthur ..... F24H 9/1818 392/459
1,604,980 A * 11/1926 Dominguez ..... F24H 9/2021 392/453
1,984,017 A * 12/1934 Hanlon ..... F24H 1/181 220/612
2,218,999 A * 10/1940 White ..... H05B 6/108 219/628
2,510,456 A * 6/1950 Biebel ..... F24H 9/1818 392/459
2,784,291 A * 3/1957 Harney ..... F24H 1/202 392/452
3,043,467 A * 7/1962 Schwebel ..... F24H 9/0042 220/567.3
3,207,358 A * 9/1965 Fliss ..... F24H 1/183 219/385
3,546,429 A * 12/1970 Phillips ..... F24H 1/202 392/452

(Continued)

*Primary Examiner* — Thor S Campbell

(74) *Attorney, Agent, or Firm* — Guy J. Houle; Houle Patent Agency Inc.

(57) ABSTRACT

A water holding tank for electric water heaters is described and particularly an improvement to the bottom end construction of the tank to prevent bacteria proliferation and the elimination of the cavitated circumferential area where sediments deposit to form a culture bed for bacteria to proliferate. Instead of modifying the shape of the bottom wall the improvement is a simple solution in that a filler material is set in at least a lowermost portion, and preferably a major portion, of the cavitated circumferential area to isolate that area from the interior of the water holding tank and form smooth flat surface areas which are planar to cause sediments to disperse and not form beds for bacteria to proliferate.

17 Claims, 2 Drawing Sheets

(56) References Cited

U.S. PATENT DOCUMENTS

| | | | | | |
|---|---|---|---|---|---|
| 4,714,053 | A * | 12/1987 | Perry | F24H 9/0042 | 122/159 |
| 4,858,563 | A * | 8/1989 | Perry | F24H 9/0042 | 122/382 |
| 5,137,053 | A * | 8/1992 | Kale | F24H 9/124 | 137/341 |
| 5,168,546 | A * | 12/1992 | Laperriere | F24D 17/0073 | 122/14.22 |
| 5,178,351 | A * | 1/1993 | Lesage | A47J 36/34 | 220/636 |
| 5,715,569 | A * | 2/1998 | Dickey | A47L 9/02 | 15/395 |
| 5,808,277 | A * | 9/1998 | Dosani | F24D 17/0073 | 219/481 |
| 5,921,207 | A * | 7/1999 | DiSalvo | F24H 9/0042 | 122/19.1 |
| 6,808,639 | B2 * | 10/2004 | Rawson | C02F 1/74 | 210/149 |
| 9,222,697 | B2 * | 12/2015 | Rodriguez | F24H 1/181 | |
| 9,404,690 | B2 * | 8/2016 | DuPlessis | F28D 1/06 | |
| 2008/0107409 | A1 * | 5/2008 | Lesage | F24H 1/202 | 392/454 |
| 2012/0272927 | A1 * | 11/2012 | Jonsson | F24D 11/002 | 122/19.1 |
| 2016/0169555 | A1 * | 6/2016 | Rissler | F24H 9/02 | 122/19.2 |
| 2018/0290899 | A1 * | 10/2018 | Lesage | C02F 1/02 | |
| 2019/0072283 | A1 * | 3/2019 | Lesage | F24D 17/0073 | |

* cited by examiner

BACTERIA PREVENTIVE WATER HOLDING TANK CONSTRUCTION FOR ELECTRIC WATER HEATERS

FIELD OF THE INVENTION

The present invention relates to water holding tanks of electric water heaters and more specifically to the construction of the bottom end section of the tank and an improvement thereof to prevent bacteria proliferation and preferably the *Legionella* bacterial.

BACKGROUND OF THE INVENTION

Although some species of *Legionella* bacteria can be found in the soil, most species live in water that is stagnant and wherein such bacteria survive under a wide range of temperatures, typically 70 to 115 degrees F., according to some studies. The Centers for Disease Control and Prevention, USA, has reported that between 8,000 and 18,000 people are hospitalized with Legionnaires disease each year. It is of great public concern as its fatality rate during an outbreak ranges from 5% to 30% in those who contract the disease. Actively managing the risk of *Legionella* in water systems is more cost effective than responding to an outbreak. Outbreaks of *Legionella* pneumophila can stem from showers and potable water systems. As water from such sources aerosolized, individuals can inhale the *Legionella* containing droplets and the organism is aspirated into the lungs.

The formation and multiplication of such *Legionella* bacteria is not only promoted by the temperature in the customary hot water systems, but also by the fact that dead spaces are present in such water distribution systems in which deposits and sediment formation can arise, and typically in the bottom zone of water heater tanks. Deposits therein can represent a culture medium for bacteria proliferation.

Most electric water heaters for domestic use have its water tank constructed with a dome shaped bottom wall. Such dome-shaped bottom walls form a surrounding cavitated zone about the dome-shaped wall where sediments gather and where water is less agitated and most often stagnant. This cavitated zone becomes progressively narrow as the inner surface of the dome-shaped bottom wall merges towards the bottom end section of the tank circumferential side wall forming a narrow gap in which sediments accumulate and pile up to form a bed of sediments. This bed of sediments is spaced the furthest from the bottom heating element and thus water therein is less hot creating an ideal temperature location for bacterial proliferation. Should the bottom element fail, then the water temperature at the bottom of the tank will drop. In a study reported in 2011 and entitled "Sporadic Legionnaires disease: the role of domestic electric hot-water tanks", by S. F. Dufresne, et al, and published by the Cambridge University Press 2011, water samplings were extracted from the drains at the bottom of several domestic water heaters and analysed. This study revealed a few positive samples at water temperature of 133 degrees Fahrenheit and that the bacteria was not present at temperatures of 135 degrees Fahrenheit and above. The World Health Organization recommends that hot water temperature be maintained above 131 degrees Fahrenheit. When hot water is not drawn from a water heater, the water inside the tank becomes stagnant and the water temperature stratifies with the cooler temperature being at the bottom region of the tank. Water within the cavitated zone below the bottom element of the tank can fall to about 85 to 105 degrees F. which is favourable to bacteria growth. Lowering the bottom element to place it close to the bottom wall of the tank has not proven to be a viable solution.

Reference is made to U.S. Pat. Nos. 4,940,024; 5,168,546 and 5,808,277 which disclose various methods and apparatus to prevent bacteria proliferation in electric water heaters. One method teaches adding a heating element in the form of a belt or patch on the outside of the tank against the bottom end of the outer sidewall of the tank to heat the water at the bottom end of the tank to a temperature preferably above 131 degrees F. Accordingly, this proposed solution provides an extra heating element in the form of a patch heater located in an area which is usually filled with insulating foam material and not practical to access should it fail and require replacement or repair. It is also costly and consumes more electricity. In U.S. Pat. No. 5,808,277 a third element is added into the tank to periodically raise the water temperature at the bottom of the tank beyond the pre-set consumption temperature, to a sanitizing temperature to destroy bacteria. This is also a costly proposition. U.S. Pat. No. 4,940,024 discloses a method of directing the cold water flow of all consumed drinking or domestically used water through the lower region of the tank wherein there is no stagnant water and wherein no deposits can be formed for bacteria growth. Accordingly, the lower region of the tank is continuously flushed with fresh water. This is a costly solution requiring a new tank design and cold water conduit network and therefore also not a viable solution.

The study reported in 2011 confirms that the bottom circumferential cavitated area between the bottom end section of the tank side wall and the dome-shaped bottom wall and this cavity gets progressively narrower down to its lower end and creating stagnant water niches for sediments to accumulate and form a culture bed and permissive environment for biofilm formation and proliferation of microorganisms, including free-living amoebas and *Legionella*. A solution to this problem thus becomes an urgent need.

In our recently filed U.S. patent application Ser. Nos. 15/731,020, filed Apr. 10, 2017 and 15/731,956, filed Sep. 1, 2017 there is described various heating means to heat the dome shaped bottom wall of the tank to prevent bacteria proliferation in the cavitated area. We also disclose the recirculation of hot water from the uppermost region of the tank where the water temperature is in the environment of 140 degrees F. to the bottom area of the tank for a predetermined time period to sanitize the bottom end of the tank during certain time periods and periodically. Because the prevention of the *Legionella* bacteria in such tanks is of utmost importance for people's health continuous research is ongoing in an attempt to find a solution to eradicate this public risk.

SUMMARY OF THE INVENTION

It is a feature of the present invention to provide an improved tank construction for electric water heaters and which substantially eliminates the danger zone in the cavitated circumferential area surrounding the dome-shaped bottom wall of the water holding tank where there is a risk of bacteria proliferation and wherein the improvement is economical and simple.

It is a further feature of the present invention to provide a tank construction for electric water heaters and wherein a filler material isolates the danger zone in the cavitated circumferential area of the tank surrounding the dome-shaped bottom wall from the tank interior.

A still further feature of the present invention is to provide a tank construction for electric water heaters and wherein the tank bottom wall is modified by a filler material which creates a bottom tank inner surface on which sediments can disperse and which has a substantially smooth and generally planar surface or surfaces free from cavities in which bacteria can proliferate.

Another feature of the present invention is to provide a method of constructing a water holding tank for electric water heaters and wherein at least a bottom portion of the cavitated circumferential area about the dome-shaped bottom wall is filled with a filler material which sets therein to isolate at least a substantial portion of the cavitated circumferential area and to form a bottom tank inner surface which has smooth and generally planar surfaces on which sediments can disperse and which isolates at least the lowermost portion of the cavitated circumferential area from the tank interior.

According to the above features, from a broad aspect, the present invention provides a water holding tank for an electric water heater and which comprises a cylindrical side wall, a top wall and a dome-shaped bottom wall. A cavitated circumferential area is defined between a lower end section of the cylindrical side wall and the dome-shaped bottom wall. A filler material is set in at least a lowermost portion of the cavitated circumferential area to fill and isolate the at least lowermost portion of the cavitated circumferential area from the interior of the water holding tank.

According to another broad aspect of the present invention there is provided an electric water heater which comprises a water holding tank having a cylindrical side wall, a top wall and a dome-shaped bottom wall. A hot water conduit extracts hot water from an upper portion of the tank. A cold water inlet releases water under pressure in a lower portion of the tank. Two or more resistive heating elements heat water in the upper and a lower portion of the tank. Temperature sensing and control means is provided to operate the resistive heating elements to heat water within the tank portions to a pre-set desired temperature. A cavitated circumferential area is defined between a lower end section of the tank cylindrical side wall and the dome-shaped bottom wall. A a filler material fills at least a lowermost portion of the cavitated circumferential area to isolate the at least lowermost portion of the cavitated circumferential area from the lowermost region of the tank.

According to a still further broad aspect of the present invention there is provided a method of constructing a water holding tank for an electric water heater. The method comprises the steps of securing a dome-shaped bottom wall to a cylindrical side wall as part of the water holding tank. The dome-shaped bottom wall and a lower end section of the cylindrical side wall form an internal cavitated circumferential area about the dome-shaped bottom wall. A predetermined quantity of a settable fluid filler material is applied in at least a lowermost portion of the cavitated circumferential area and distributed substantially uniformly thereabout to fill and isolate the at least lowermost portion of the cavitated circumferential area from the interior of the water holding tank.

BRIEF DESCRIPTION OF THE DRAWINGS

A preferred embodiment of the present invention and modifications thereof will now be described with reference to the accompanying drawings in which.

DETAILED DESCRIPTION OF THE PREFERRED EMBODIMENT

Figure 1:
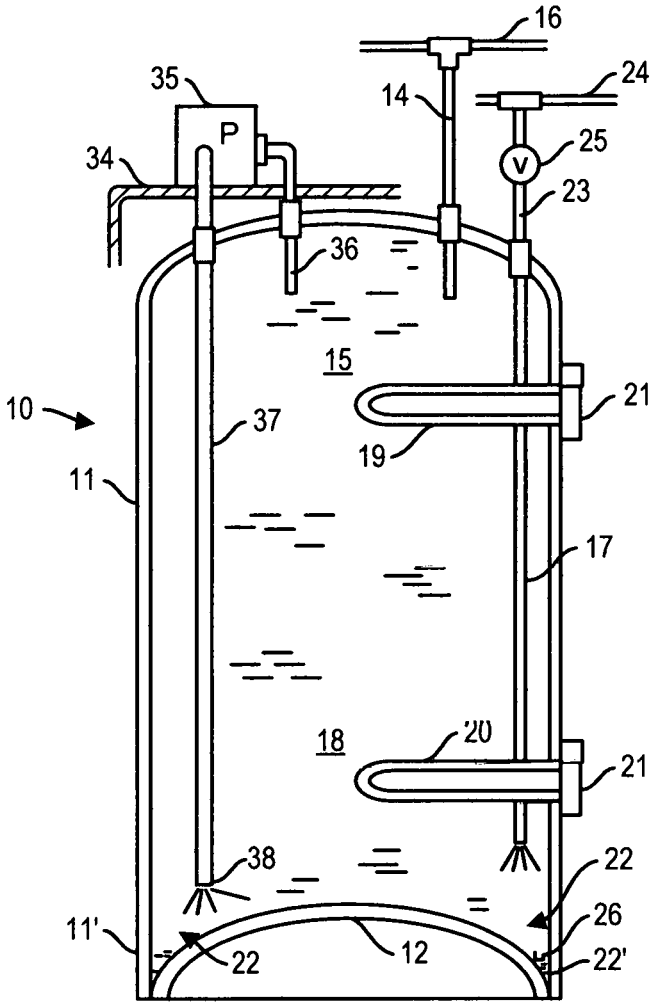
FIG. 1 is a simplified fragmented side view of an electric water heater showing basic components thereof and in which sediments build-up is illustrated in the cavitated circumferential area about the dome-shaped bottom wall and further illustrating a recirculating pump mounted on the top wall of the casing of the water heater.

Referring to the drawings and more specifically to FIG. 1, there is shown generally at 10 a water holding tank of an electric water heater and basic component parts thereof. The water holding tank 10 is formed of steel and has a cylindrical side wall 11, a dome-shaped bottom wall 12 and a top wall 13 all secured together by welding. A hot water conduit 14 is secured to the top wall 13 and projects into the upper portion 15 of the tank to extract hot water therefrom when demanded by appliances connected to the hot water distribution line 16. A dip tube 17 is secured to the top wall 13 and extends to the bottom portion 18 of the tank and spaced a predetermined distance above the dome-shaped bottom wall 12. A pipe connection 23 interconnects the domestic water supply line 24 to the dip tube through a shut-off valve 25. Instead of the dip tube 17, the cold water inlet can also be fed through a coupling adjacent the bottom end of the cylindrical side wall as used with some tank construction. As herein illustrated a top resistive heating element 19 is secured to the tank side wall 11 and extends into the upper portion 15 of the tank. Likewise, a bottom resistive heating element 20 is secured to the tank side wall 11 and extends into the bottom portion 18 of the tank to heat water therein. The resistive heating elements 19 and 20 are controlled by respective temperature sensing and control thermostats 21 which are pre-set to heat water within their respective portions to a desired water temperature, usually 140 degrees Fahrenheit.

Figure 2:
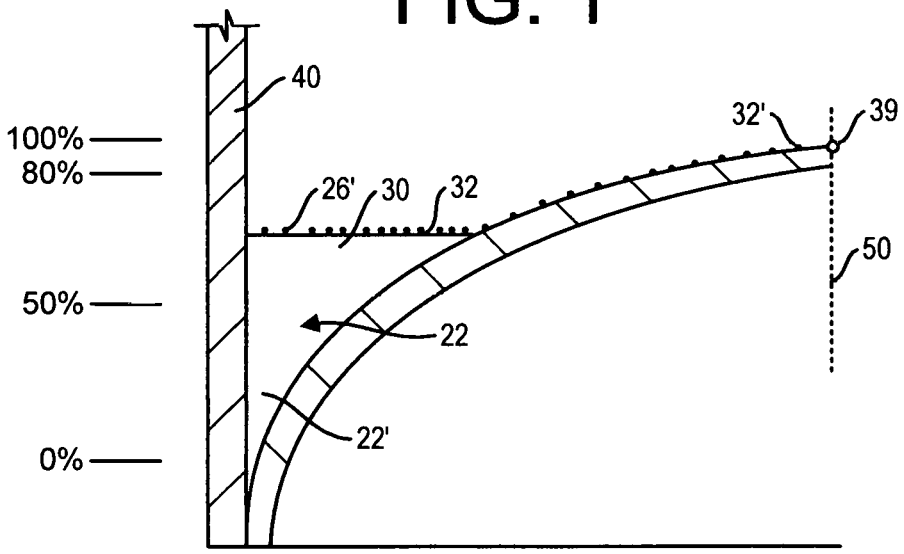
FIG. 2 is an enlarged cross-sectional view of the cavitated circumferential area about the dome-shaped bottom wall showing a filler material set therein.

With further reference to FIG. 2, it can be seen that the dome-shaped bottom wall 12 and the lower end section 11' of the cylindrical side wall 11 form a cavitated circumferential area 22 all around the outer portion of the dome-shaped bottom wall 12. Also, this cavitated area diminishes in width towards its bottom end 22' which is very narrow. Over time, sediments from the domestic water supply line 24 enters the tank 10 and deposit on the dome-shaped bottom wall and precipitate into the bottom end 22' of the cavitated area due to the slopping shape of the bottom wall and forms a sedimentary bed 26 in which bacteria, such as the *Legionella* bacteria, can survive and propagate for the reason that this area 22' is spaced furthest away from the bottom resistive heating element 20 where water within the tank is often stagnant and at its lowest temperature. As mentioned in the research discussed above, *Legionella* bacteria can be present in water temperatures of about 130 degrees Fahrenheit and slightly higher and this sedimentary bed 26 can constitute an ideal culture bed location for such bacteria to develop.

In order to prevent the formation of such sedimentary culture bed 26 the present invention is a simple solution which is simply to isolate the cavitated circumferential area 22 from the bottom end of the tank 10 by introducing therein a suitable filler material 30 to isolate, at least the lowermost portion 31 of the cavitated circumferential area 22 from the lowermost region 18 of the tank. By doing so, the bottom surface of the tank presents a smooth planar surface section 32 in the cavitated circumferential area 22 without crevices or cavities in which sediments can stack-up. Also, the dome shaped area 32' is now reduced to a very shallow dome shape form. Accordingly, sediment deposits 26' will disperse on such surfaces and become free moving thereon and because the bottom surface section 32, in the cavitated area is now closer to the bottom heating element 20, the water temperature at this surface section will be higher and above 135 degrees Fahrenheit at which the *Legionella* bacteria cannot survive.

In our co-pending U.S. patent application Ser. No. 15/731,021, filed Apr. 10, 2017 there is described the use of a water pump to introduce hot water from the upper portion 15 of the tank into the lower portion 18 and above the cavitated circumferential area 22 whereby to bring the water temperature in the cavitated area 22 to a temperature sufficiently high, about 140 degrees Fahrenheit, to kill any bacteria that may live in the cavitated area. Such is illustrated in FIG. 1 where it can be seen that a pump 35 is mounted on the top surface of the water heater casing 34 and has a conduit 36 extending inside the tank to the upper portion 15 thereof where it draws hot water, usually at a temperature of about 140 degrees Fahrenheit, and releases it to the bottom region 18 of the tank through an open end 38 of a conduit 37 secured to the tank top wall 13. Because the bottom end of the tank now has a mostly smooth planar-like surface 32, or surface sections, this hot water becomes more uniformly distributed over the surface 32 forming a hot water strata that sanitizes the bottom end of the tank preventing bacterial proliferation. To sanitize the tank this pump is placed in operation for 3 to 4 hours and the pump circulates a gentle water flow not to create a turbulence to cause the sediments to flow upwards towards the upper region 15 of the tank where water is drawn as such sediments may cause problems in the mixing valves of faucets connected to the hot water distribution line 16. As shown in FIG. 2, the filler material 30, as herein illustrated, fills about 80% of the cavitated circumferential area 22. However, filling at least the lowermost portion, about 50% of the depth of the cavitated area, would provide a viable solution for the reason that the crevice portion of the cavitated circumferential area is eliminated and the remaining cavitated area is wider, flat and shallow and extends closer to the apex 39 of the dome-shaped bottom wall 12. Of course, the circumferential cavitated area could be filed entirely with a filler material to create a smooth bottom surface across the tank. The location of the drain outlet 40 of the tank is also re-positioned to lie slightly above the bottom surface of the filler material 30. A drain valve, not shown but obvious to a person skilled in the art, is connected to the drain outlet 40.

Figure 3:
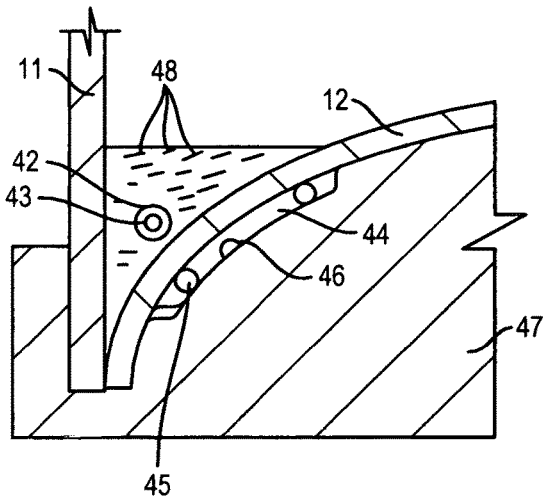
FIG. 3 is an enlarged cross-sectional view of the cavitated circumferential area illustrating a modification wherein a heating element is incorporated in the filler material.

The filler material 30 may consist of various suitable materials such as an epoxy resin or a cement material. As shown in FIG. 3 an epoxy resin material 41 is used as the filler. Also, a modification is herein shown where a curved metal conduit, preferably a copper tube 42 having a heating wire 43 therein is disposed in the cavitated circumferential area 22 prior to pouring the epoxy therein to embed the tube 42 therein to heat the epoxy or cement to 135 degrees F. or above to raise the temperature of water thereover to a safe temperature. Such a filler material has thermal conductive properties. The tube 42 and wire 43 are mounted in such a way as to permit the removal and connection of the wire in the lower thermostat area described in one of our co-pending applications referred to herein. Also, a heating film 44 having a heating wire 45 supported therein can be mounted in a cavity 46 formed on the outer surface of the foam base 47 and located in contact with the dome-shaped bottom wall 12 adjacent the cavitated area 22, as also described in one of our co-pending applications. Suitable heat conductive metal particles 48 may also be mixed with the epoxy to improve its conductivity.

Figure 4:
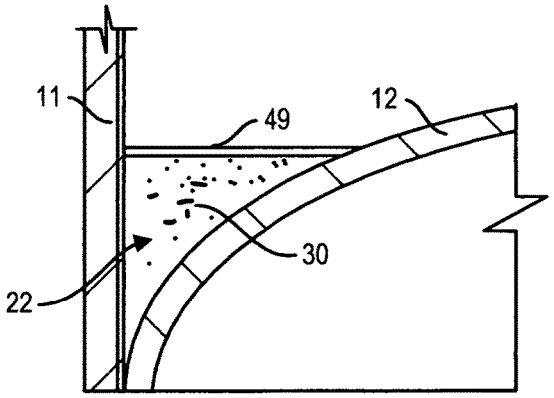
FIG. 4 is an enlarged cross-sectional view of the cavitated circumferential area illustrating a still further modification wherein a silver-copper salt or other anti-bacterial substance is incorporated into the upper surface of the filler material.

FIG. 4 illustrates a still further modification wherein the filler material 30, either an epoxy or cement material, has a silver-copper salt 49 applied on the surface thereof and adhered thereto when the filler hardens and sets. An anti-microbial agent or zinc powder particles or combinations of any of the particles and the salts may also be applied to the surface to prevent bacteria growth, provided any of such salts or agents or combinations thereof are not hazardous to public health. The cement filler material is a low viscosity cement having superior body strength which will not decompose, retract, crack or disconnect when hard set and exposed to water at various temperatures including water temperatures up to about at least 190 degrees Fahrenheit.

Figure 5A:
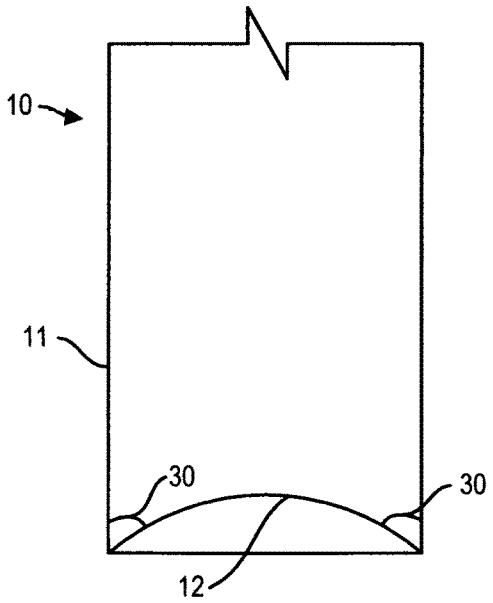
FIG. 5A is a schematic view of the water holding tank illustrating a construction stage at which a filler material is deposited in the cavitated circumferential area.
Figure 5B:
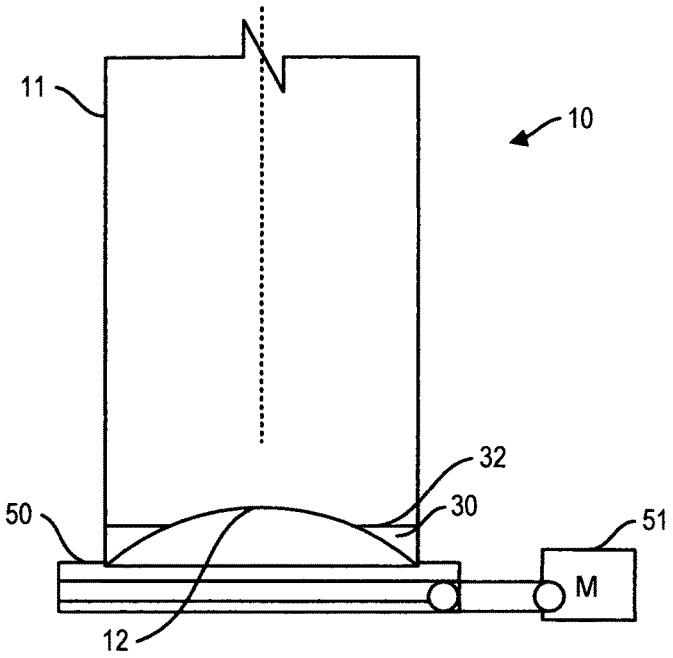
FIG. 5B is a schematic view of the water holding tank showing the tank sitting vertically on a vibrating platform to cause the filler material to evenly distribute about the cavitated circumferential area.

The method for constructing the tank 10 is relatively simple as is the proposed solution of eliminating the cavitated circumferential area to prevent the formation of a culture bed in which bacteria can proliferate. The method comprises, after the dome-shaped bottom wall 12 is welded to the cylindrical side wall 11, of inserting a predetermined quantity of the filler material 30 in a substantially fluid state in the cavitated circumferential area 22 from the inside of the cylindrical side wall and distributed about the cavitated area 22 to fill and isolate at least the lowermost portion of the cavitated area, as shown in FIG. 5A. The filler material 30 is preferably, although not exclusively a quick-set filler material. Thereafter, as shown in FIG. 5B, the tank is dispose vertically on a vibrating platform 50 and is imparted vibrations by a motor 51 to cause the fluid filler material to substantially evenly distribute about the cavitated circumferential area 22 and rid itself of any air pockets and form a smooth flat filler surface.

It is within the ambit of the present invention to cover all obvious modifications of the preferred embodiment described herein provided such modifications fall within the scope of the appended claims.

The invention claimed is:

1. An electric water heater comprising a water holding tank having a cylindrical side wall, a top wall and a dome-shaped bottom wall; a hot water conduit for extracting hot water from an upper portion of said tank, a cold water inlet for releasing water under pressure in a lower portion of said tank, two or more resistive heating elements secured to said cylindrical side wall to heat water in said upper and said lower portion of said tank, temperature sensing and control means to operate said resistive heating elements to heat water within said tank portions to a pre-set desired temperature, a cavitated circumferential area defined between a lower end section of said tank cylindrical side wall and said dome-shaped bottom wall, and a filler material in said cavitated circumferential area, said filler material being of a predetermined volume to fill and isolate more than 50% of the depth of said cavitated circumferential area as measured from its lowermost narrow point to an apex of a top surface of said dome-shaped bottom wall to form a bottom upper surface in said cavitated circumferential area which is flat and smooth and on which sediments will disperse and not form said sedimentary bed in which bacteria can proliferate, said bottom upper surface also providing a substantially planar surface which is closer to a bottom one of said two or more resistive heating elements over which the temperature of water within said tank is at or above 135 degrees Fahrenheit and substantially constant.

2. The electric water heater as claimed in claim 1 wherein a drain outlet is disposed in said cylindrical side wall slightly above an upper surface of said filler material, said drain outlet having a closure means.

3. The electric water heater as claimed in claim 1 wherein said filler material is one of a polymer and a cement hard settable material.

4. The electric water heater as claimed in claim 3 wherein said polymer material is an epoxy resin material.

5. The electric water heater as claimed in claim 4 wherein said epoxy resin has thermally conductive properties, and an electrical heating element held captive in said epoxy resin to heat said resin to at least a temperature of 135 degrees F.

6. The electric water heater as claimed in claim 5 wherein said heating element is a heating wire removably retained in a thermally conductive conduit set in said epoxy resin.

7. The electric water heater as claimed in claim 5 wherein heat conductive particles are mixed with said epoxy resin to improve the thermal conductivity thereof.

8. The electric water heater as claimed in claim 3 wherein said cement material is a low viscosity cement having a body strength capable of resisting to decomposition, retraction, cracking or becoming disconnected when exposed to water at various temperatures including water temperatures of up to about 190 degrees F.

9. The electric water heater as claimed in claim 8 wherein said cement material includes in its cementitious mixture one of an anti-microbial agent, aluminum particles, copper particles and zinc particles and combinations thereof.

10. The electric water heater as claimed in claim 1 wherein said filler material has thermally conductive properties, and electric heating means interposed between an insulating support base disposed under said dome-shaped bottom wall and an outer surface of said dome-shaped bottom wall to heat said filler material to said temperature at or above 135 degrees Fahrenheit and sufficient to sanitize said tank lower region immediately above a bottom upper surface of said tank.

11. The electric water heater as claimed in claim 1 wherein there is further provided recirculation means connected to said hot water conduit exteriorly of said tank and to a conduit means having an opening in said lower region of said tank and disposed above said bottom upper surface to cause a gentle hot water flow to sanitize water in said tank at said bottom upper surface and prevent bacteria proliferation in said tank lower region.

12. A water holding tank for an electric water heater, said tank comprising a cylindrical side wall, a top wall and a dome-shaped bottom wall; a cavitated circumferential area defined between a lower end section of said cylindrical side wall and said dome-shaped bottom wall, and a filler material set in at least a lowermost portion of said cavitated circumferential area to fill and isolate said at least lowermost portion of said cavitated circumferential area from an interior of said water holding tank to isolate at least a lowermost portion of said cavitated circumferential area to prevent the formation of a sedimentary bed in which bacteria can proliferate, said filler material being of a predetermined quantity to fill said at least a major portion of said cavitated circumferential area to form a water holding tank inner bottom wall surface which is substantially planar or having substantially planar portions.

13. The water holding tank as claimed in claim 12 wherein said filler material is one of a polymer filler material and a cement material.

14. The water holding tank as claimed in claim 13 wherein said polymer material is an epoxy material having one of an anti-microbial agent, aluminum particles, copper particles and zinc particles and combinations thereof mixed therewith.

15. The water holding tank as claimed in claim 12 wherein said filler material has thermally conductive properties and wherein electrical heating means is provided to heat said filler material to at least a temperature of 135 degrees F. or deposited on an upper surface thereof.

16. A method of constructing a water holding tank for an electric water heater, said method comprising the steps of:

(i) securing a dome-shaped bottom wall to a cylindrical side wall as part of said water holding tank, said dome-shaped bottom wall and a lower end section of said cylindrical side wall forming an internal cavitated circumferential area, and (ii) inserting a predetermined quantity of a settable fluid filler material in at least a lowermost portion of said cavitated circumferential area and distributed substantially uniformly thereabout to fill and isolate said at least lowermost portion of said cavitated circumferential area from an interior of said water holding tank to isolate at least a lowermost portion of said cavitated circumferential area by forming a holding tank inner bottom wall surface which is mostly smooth and planar-like and free of any crevices and cavities in which sediments can accumulate to prevent the formation of a sedimentary bed in which bacteria can proliferate.

17. A method of constructing a water holding tank for an electric water heater, said method comprising the steps of:

(i) securing a dome-shaped bottom wall to a cylindrical side wall as part of said water holding tank, said dome-shaped bottom wall and a lower end section of said cylindrical side wall forming an internal cavitated circumferential area, and (ii) inserting a predetermined quantity of a settable fluid filler material in at least a lowermost portion of said cavitated circumferential area and distributed substantially uniformly thereabout to fill and isolate said at least lowermost portion of said cavitated circumferential area from an interior of said water holding tank to isolate at least a lowermost portion of said cavitated circumferential area to prevent the formation of a sedimentary bed in which bacteria can proliferate, and wherein in said step (ii) comprises vibrating said water holding tank on a vibrating platform with said cylindrical side wall extending vertically to cause said fluid filler material to evenly distribute about said cavitated circumferential area and rid itself of air pockets and form a smooth top upper surface.

* * * * *